US005351878A

United States Patent [19]

Cooper

[11] Patent Number: 5,351,878

[45] Date of Patent: Oct. 4, 1994

[54] WRAP-AROUND CARRIER WITH END RESTRAINTS

[75] Inventor: Leonard M. Cooper, West Monroe, La.

[73] Assignee: Riverwood International Corporation, Atlanta, Ga.

[21] Appl. No.: 152,550

[22] Filed: Nov. 12, 1993

[51] Int. Cl.[5] ..... B65D 85/62

[52] U.S. Cl. ..... 206/427

[58] Field of Search ..... 229/40; 206/140, 427

[56] References Cited

U.S. PATENT DOCUMENTS

| | | | |
|---|---|---|---|
| 2,931,490 | 4/1960 | McGihon | 206/427 |
| 3,167,214 | 1/1965 | Mahon | 229/40 |
| 3,640,448 | 2/1972 | Wood | 229/40 |
| 3,715,029 | 2/1973 | Wood | 229/40 |
| 3,963,121 | 6/1976 | Kipp | 229/40 |
| 4,440,340 | 4/1984 | Bakx | 229/40 |
| 4,836,375 | 6/1989 | Schuster et al. | 229/40 |
| 5,000,313 | 3/1991 | Oliff | 229/40 |
| 5,060,792 | 10/1991 | Oliff | 229/40 |
| 5,180,054 | 1/1993 | Bakx | 206/140 |
| 5,197,598 | 3/1993 | Stout et al. | 206/427 |

FOREIGN PATENT DOCUMENTS

| | | | |
|---|---|---|---|
| 1040748 | 9/1966 | United Kingdom | 229/40 |

*Primary Examiner*—Gary E. Elkins

[57] ABSTRACT

A wrap-around carrier having lower article end restraints and upper end panel flaps. The lower end restraints are comprised of lower gusset panels connecting the bottom panel to side panel flaps, while the upper end panel flaps are connected to the side panel flaps by upper gusset panels. The end panel flaps and the end restraints automatically fold into their operable position when the side panel flaps are folded during fabrication of the carrier.

3 Claims, 3 Drawing Sheets

WRAP-AROUND CARRIER WITH END RESTRAINTS

FIELD OF THE INVENTION

This invention relates to wrap-around article carriers. More particularly, it relates to wrap-around carriers which include means for preventing the end articles from falling out of the carrier.

BACKGROUND OF THE INVENTION

Wrap-around carriers are formed by grouping a number of articles to be packaged in the same arrangement they will have in the package, then wrapping a carrier blank around them and securing the ends of the blank together. Although some wrap-around carriers include integral end panels, most are open-ended. The upper portions of the end articles are sometimes prevented from moving out the open ends of the carrier by openings in the side panels through which portions of the bottle tops protrude or by openings in the top panel through which the bottle necks extend. The bottom portions of the articles are normally prevented from moving out through the open ends by tightly wrapping the carrier blank around them and also by designing the package so that they protrude through openings in the side panels of the carrier- For example, cutouts in the side panels are conventionally employed to receive the flanges of cans and other flanged articles, while heel cutouts in the lower portions of the side panels are employed to receive the heels or bases of beverage bottles.

While such measures have been successful in containing bottles of traditional design in their wrap-around carriers, new bottle designs do not always lend themselves to conventional treatment. The trend to larger beverage bottles makes it incumbent to employ carriers that are not only structurally capable of supporting heavier loads but are able to positively prevent outward movement of the end bottles. This becomes even more difficult when the bottle design is such that it no longer includes a conventionally shaped heel which normally would be held in place by a heel cutout. The packaging of bottles whose bottom portions have spaced inwardly sloped feet, such as those found in petaloid bottom designs, is particularly difficult in this respect.

It would be desirable to be able to employ wrap-around carriers to package bottles and other articles whose design makes it difficult or impossible to be held in place by side panel cutouts, and to do so without danger of the articles sliding out the ends of the carrier. It would also be desirable to design the carrier to give the open end of the package a more finished appearance, while at the same time reinforcing the end edge of the top panel against the stresses of lifting and carrying packages containing heavy articles, such as large beverage bottles.

BRIEF SUMMARY OF THE INVENTION

The wrap-around carrier of the invention is comprised of side panels foldably connected to a top panel and to bottom panel flaps as is well known in the art. In addition, the carrier includes both end flaps extending down from the top panel and lower article restraints. Side panel flaps connected to the end edges of the side panels are inwardly folded between the side panels and adjacent end articles in the package and are further connected to upper gusset panels, which connect each side panel flap to the end flaps, and to lower gusset panels, which connect each side panel flap to the end edge of an adjacent bottom panel flap. The lower gusset panels act as lower article restraints and the upper gusset panels are in substantially face-to-face contact with upper portions of the side panels.

When forming the package, the side panel flaps are folded into place as the carrier blank is wrapped around the articles to be packaged. The upper gusset panels automatically fold the end panel flap down from the top panel while the lower gusset panels are automatically raised into operable position.

The carrier firmly holds the articles in place as described in more detail below, and is quite economical, requiring a minimum amount of stock to produce. In addition, the short end panel at the top of the package not only finishes the appearance of the package but also strengthens the ends of the top panel. Set-up of the carriers is simple and rapid, permitting the packaging machine to run at high speeds.

The above and other aspects and benefits of the invention will readily be apparent from the more detailed description of the preferred embodiment of the invention which follows.

DETAILED DESCRIPTION OF THE PREFERRED EMBODIMENTS

Figure 1:
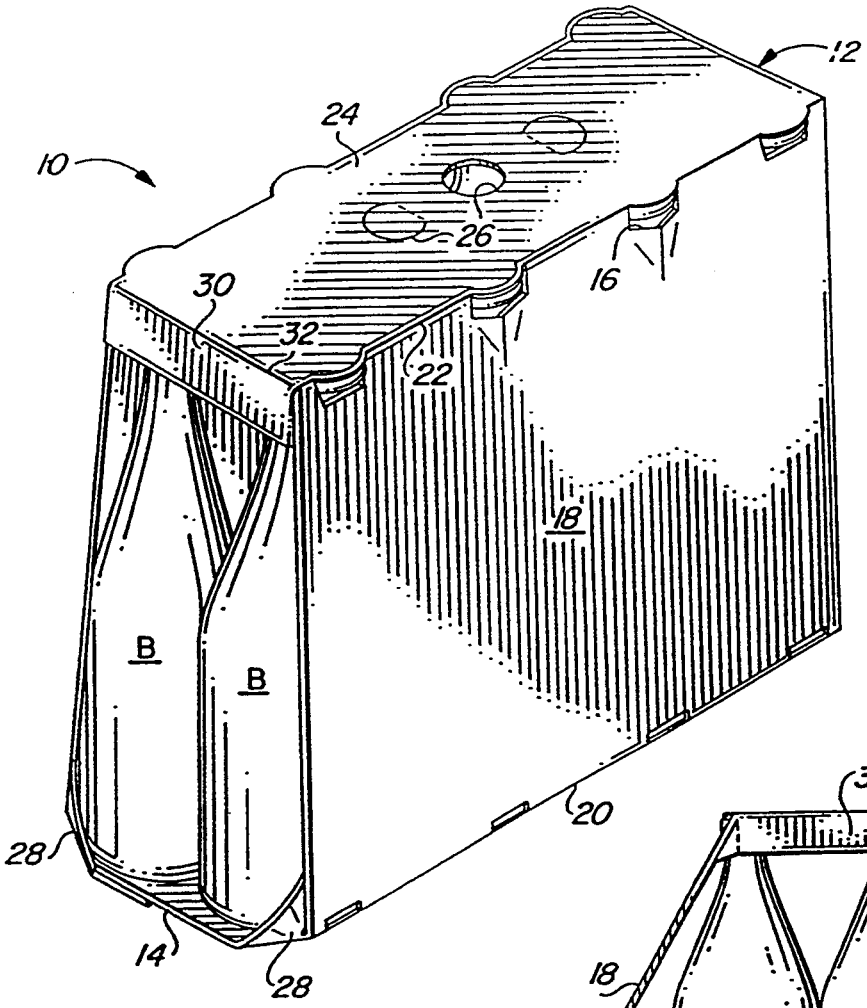
FIG. 1 is a pictorial view of one embodiment of the carrier of the invention.

Referring to FIG. 1, a package 10 is comprised of wrap-around carrier 12 and eight beverage bottles B which are supported on the bottom panel 14 of the carrier. The top outer portions of the bottles protrude through slots or openings 16 in side panels 18, which are connected by fold lines 20 and 22 to the bottom panel 14 and the top panel 24, respectively. Finger holes 26 in the top panel are provided for use as a handle when lifting the package. End restraints in the form of straps or gusset panels 28 connected to the bottom and side panels serve to hold the bottom portions of the end bottles in place to prevent them from moving out the end of the carrier. In addition, end panel flaps 30, connected to the top panel along fold lines 32, extend down from the top panel to conceal the upper portions of the end bottles from view. The bottom panels are longer than the top and side panels, thereby enabling both the end straps 28 and the end panel flaps 30 to contact the adjacent surfaces of the end bottles in the package. Because the side panels closely follow the outer surface of the bottles they are slightly sloped toward the top panel, making the top panel narrower than the bottom panel.

Figure 2:
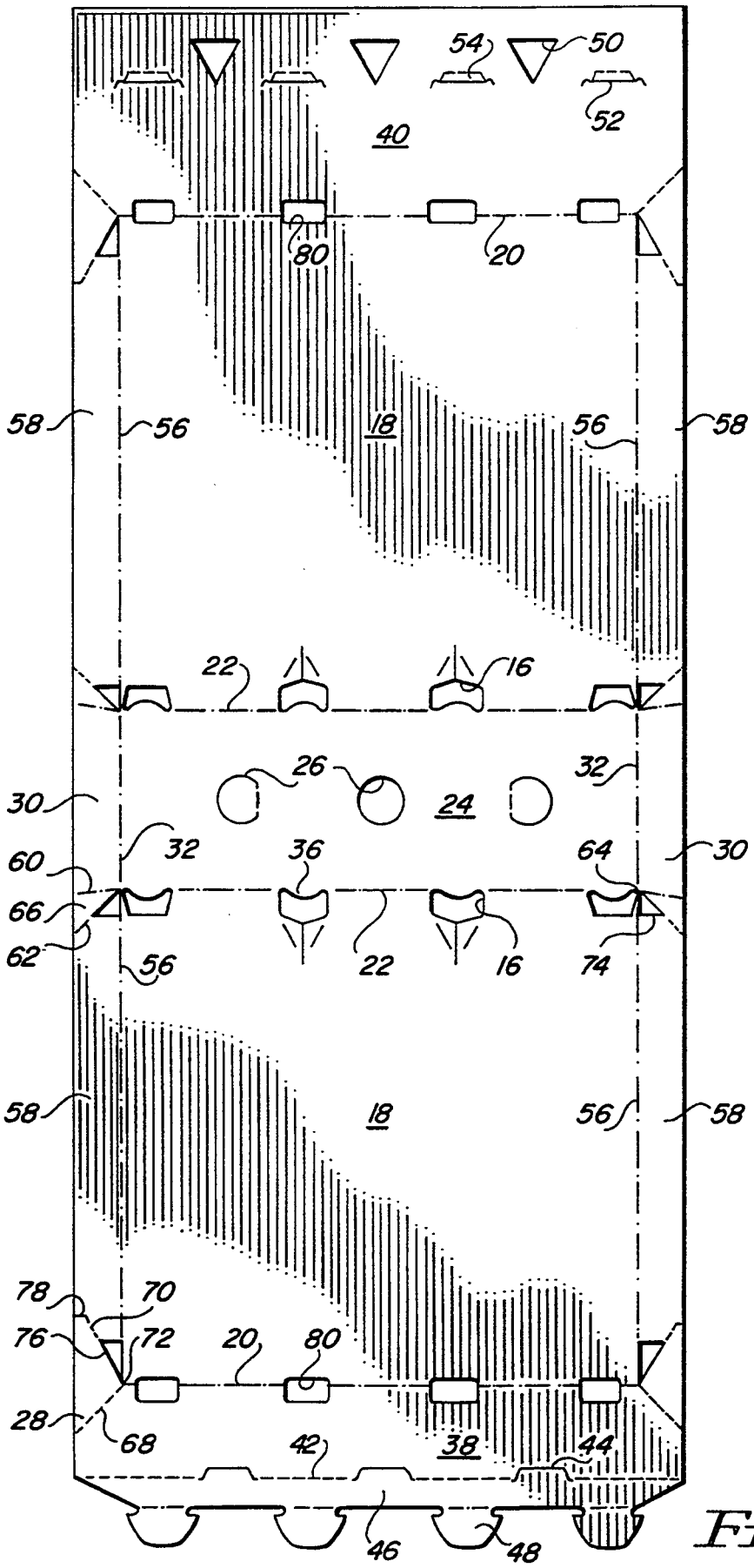
FIG. 2 is a plan view of a blank used to form the carrier of FIG. 1.

Referring now to FIG. 2, wherein like reference numerals to those used in FIG. 1 denote similar elements, a blank 34 capable of being fabricated into the carrier of FIG. 1 is comprised of a central top panel section 24 connected at opposite sides along the fold lines 22 to side panel sections 18. The fold lines 22 are interrupted by the edges of the cutouts 16 which form-tabs 36 that overlie the projecting portions of bottle caps in a carrier.

The fold lines 20 connect the side panel sections 18 to bottom panel flaps 38 and 40. The bottom panel flap 38 includes a fold line 42 which extends the full length of the flap and which is interrupted by primary male locking tabs 44. The portion 46 of the flap 38 lying outwardly of the fold line 42 serves as a locking panel which includes secondary male locking tabs 48. The bottom panel flap 40 includes cutouts having primary female locking edges 50 adapted to engage the primary male locking men, hers 44 and slits 52 adapted to receive the secondary locking tabs 48. Foldably connected tabs or flaps 54 may be provided to facilitate entry of the locking tabs 48 into the slits. Although these various locking elements are illustrated to demonstrate a typical bottom panel locking arrangement suitable for use with the carrier of the invention, it should be understood that any desired effective form of bottom panel locking means may be employed.

The fold line 32 in the top panel section 24 to which the end panel flap 30 is connected continues into the side panel sections 18 as fold line 56, forming side panel flaps 58. Fold lines 60, which are extensions of the fold lines 22, and fold lines 62, which extend diagonally from the intersection 64 of the fold lines 22 and 32, form upper gusset panels 66. The straps or lower gusset panels 28 are formed by angled fold lines 68 and 70 extending out from the intersection 72 of the fold lines 56 and 20. To facilitate folding of the gusset panels 66 by removing material which would otherwise bunch together, cutouts 74 are provided, which extend from the intersection point 64 along portions of the fold lines 62 and 56. Cutouts 76 are similarly provided from the intersection point 72 along portions of the fold lines 56 and 70. Preferably, the fold lines 70 terminate a short distance from the edge of the blank and are connected to the edge by slits 78. If desired, folding of the bottom panel flaps may also be facilitated by providing cutouts 80 at spaced locations on the fold line 20.

Figure 4:
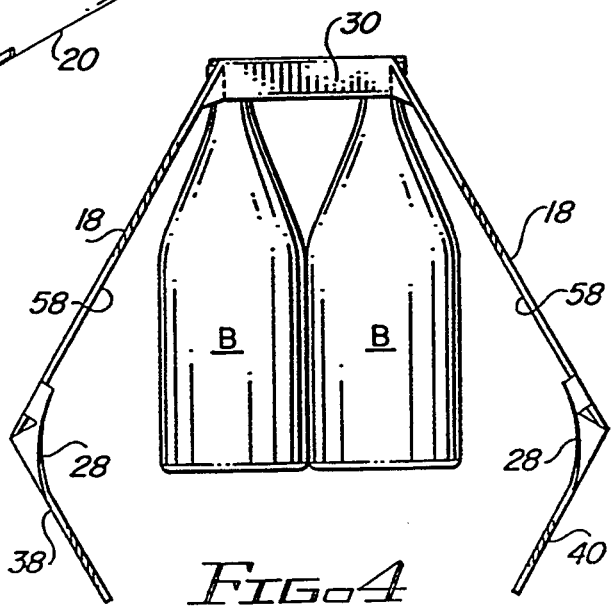
FIG. 4 is an end view similar to that of FIG. 3, but showing the blank in the process of being folded into bottom panel locking position.
Figure 3:
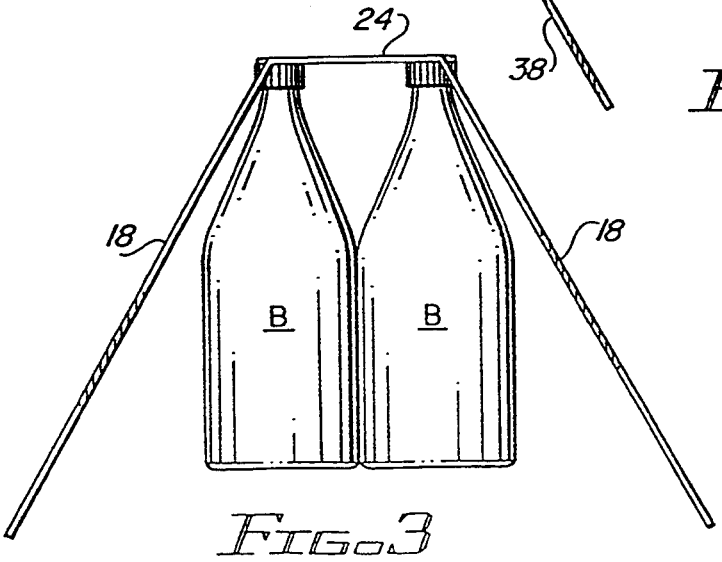
FIG. 3 is an end view of the blank in an initial stage of carrier formation after being placed on a group of bottles and initially folded.

To form a package of bottles, the bottles are grouped together as they are to be arranged in the package and the top panel section of the blank is placed on top of them. The blank is then folded down about the fold lines 22 to the initial interim condition shown in FIG. 3, with the side panel sections, the gusset panels, the end panel flaps and the bottom panel sections still in the same planar relationship as in the blank of FIG. 2. The forming operation continues by folding the side panel flaps 58 in about the fold lines 56. As the side panel flaps 58 are folded back, the fold line connections 62 and 70 pull the connecting ends of the gusset panels 66 and 28 in toward the side panels, causing the gusset panels to fold up out of the plane of the blank. This movement of the gusset panels 66 pulls the end panel flaps 30 down, as illustrated in the later interim position shown in FIG. 4. Movement of the gusset panels 28 causes the end panel flaps to fold up along the fold lines 20, also illustrated in FIG. 4.

The final step in the formation of the package is to lock the bottom panel flaps together. The details of this phase of the operation have not been illustrated since the particular locking mechanism employed does not form part of the invention. It will be understood by those familiar with the locking elements shown, however, that the outer flap portion or locking panel 46 of the bottom panel flap 38 is folded back about the fold line 42 and the primary male locking tabs 44 are engaged with the primary female locking edges 50 in bottom panel flap 40. The secondary male locking tabs 48 are then inserted through the slits 52 to complete the mechanical locking action, resulting in the package of FIG. 1.

Figure 5:
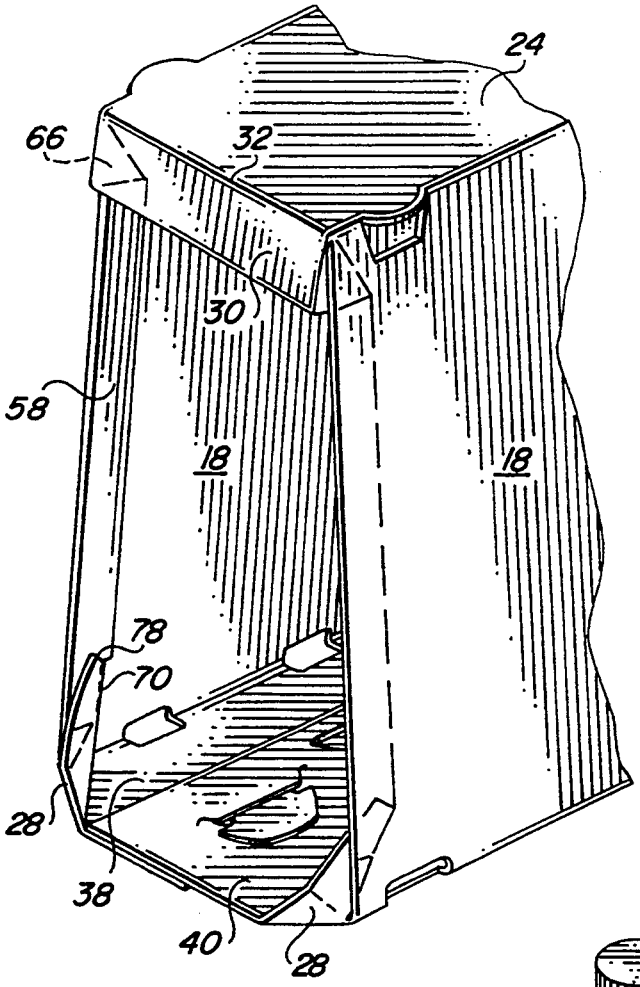
FIG. 5 is a partial pictorial view of the carrier, with the bottles omitted for the sake of clarity, illustrating the arrangement of the side panel flaps and the gusset panels.

Referring to FIG. 5, the carrier is illustrated without the bottles in order to show the end configuration of the carrier in more detail. By folding the side panel flaps 58 into face-to-face relationship with the side panels 18 as the blank is being wrapped around the bottles to be packaged, the flaps are located between the side panels and the end bottles. The tight fit of the wrap around the bottles ensures that the bottles hold the flaps in this condition. With the flaps 58 securely locked in place, the folded gusset panels 66 hold the end panel flaps 30 in their lowered position while the folded gusset panels 28 act as end restraints to prevent outward movement of the bottoms of the end bottles in the carrier.

Although it may be considered to be a matter of choice depending on the particular shape of the end articles and the lower gusset panels, it is preferred to include the short slit 78 at the upper end of the gusset panel fold line 70. This arrangement allows substantially the entire inner face of the gusset panel 28 to contact the adjacent end article while wrapping around a sufficient portion of the end article to restrain any tendency to move out of the carrier. This is particularly advantageous where the bottom panel extends out beyond the side panels so that portions of the end articles also extend out beyond the side panels. It is also advantageous to use in connection with the packaging of bottles having petalold shaped bottoms, since the restraining gusset panel has enough slack or flexibility to conform to the lower circumference of the end bottles regardless of the location of the spaced feet of the bottle.

Although not essential to the functioning of the gusset panels, it is preferred to incorporate the cutouts 74 and 76 in order to eliminate material which would otherwise tend to bunch together when the gusset panels are folded. The size of the cutouts may vary, but should not be so large as to leave the gusset panel fold lines too short to withstand the stresses to which they are subjected when pulling the end panel flaps 30 and the lower end restraints into place.

Figure 6:
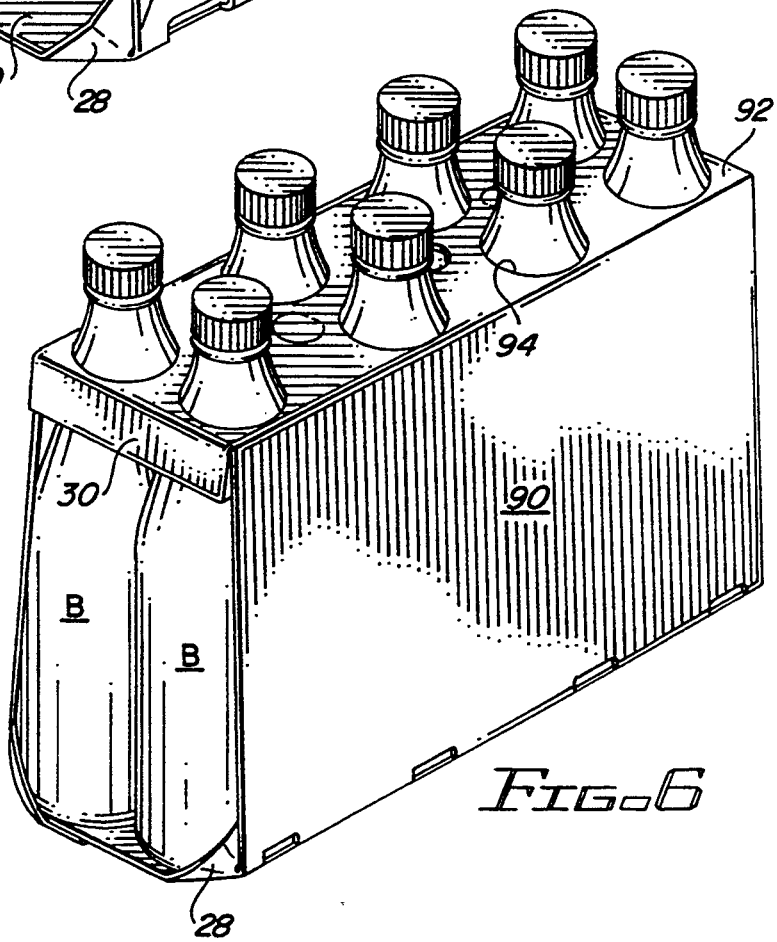
FIG. 6 is a pictorial view similar to that of FIG. 1, but showing another embodiment of the invention.

The invention is not limited to carriers designed to receive the full height of the articles but may also be incorporated in carriers which have side panels shorter than the height of the articles. Such a carrier is shown in FIG. 6, which is similar to the carrier of FIG. 1 except that the side panels 90 are shorter than the side panels 18 and the top panel 92 includes openings 94 for receiving the necks of the bottles B. Also, the shorter height of the side panels causes the top panel in this embodiment to be somewhat wider than the top panel in the first embodiment. The functioning of the upper and lower gusset panels remains the same, however, with the end panel flap 30 and the restraining gussets 28 being folded into place by the folding of the side panel flaps and being locked in place by the pressure of the end bottles against the side panel flaps. The blank for this carrier has not been shown since it is similar to the blank of FIG. 2 except for the different top panel section design and the fact that the side panel sections are shorter.

Although the invention has been described in connection with a carrier designed to hold eight bottles, it obviously may be incorporated in carriers designed to hold more or less than that and can be utilized with articles of various sizes. It can be appreciated that the invention not only provides a carrier with end gusset panels for holding bottles in place, but employs a design which automatically activates the end gusset panels and the upper end panel flap when the bottom panel flaps are moved into position to be locked together.

It should now be apparent that the invention is not necessarily limited to all the specific details described in connection with the preferred embodiments, but that changes to certain features of the preferred embodiments which do not alter the overall basic function and concept of the invention may be made without departing from the spirit and scope of the invention as defined in the appended claims.

What is claimed is:

1. A package comprised of a wrap-around carrier containing a plurality of articles, comprising:

a top panel;

a bottom panel;

end flaps connected to the top panel along fold lines;

opposite side panels, each of said side panels being connected along an upper fold line to the top panel, along a lower fold line to a bottom panel flap and along end fold lines to side panel flaps, the bottom panel flaps being connected to each other to form the bottom panel and the side panel flaps being inwardly folded between the side panels and adjacent end articles in the package;

an upper gusset panel associated with each of said side panel flaps, each of said upper gusset panels connecting one of said side panel flaps to an associated one of the end flaps;

a lower gusset panel associated with each of said side panel flaps, each of said lower gusset panels connecting one of said side panel flaps to an end edge of an adjacent one of the bottom panel flaps;

one of the articles being adjacent each of the lower gusset panels, the lower gusset panels restraining outward movement of said adjacent articles;

the bottom panel being longer than adjacent portions of the side panels; and the top panel being narrower than the bottom panel.

2. A package comprised of a wrap-around carrier containing a plurality of articles, comprising:

a top panel;

a bottom panel;

end flaps connected to the top panel along fold lines;

opposite side panels, each of said side panels being connected along an upper fold line to the top panel, along a lower fold line to a bottom panel flap and along end fold lines to side panel flaps, each side panel flap having an end edge, the bottom panel flaps being connected to each other to form the bottom panel and the side panel flaps being inwardly folded between the side panels and adjacent end articles in the package;

an upper gusset panel associated with each of said side panel flaps, each of said upper gusset panels connecting one of said side panel flaps to an associated one of the end flaps;

a lower gusset panel associated with each of said side panel flaps, each of said lower gusset panels connecting one of said side panel flaps to an end edge of an adjacent one of the bottom panel flaps;

one of the articles being adjacent each of the lower gusset panels, the lower gusset panels restraining outward movement of said adjacent articles;

each of said lower gusset panels being connected to an associated one of the bottom panel flaps along a first fold line extending at an angle from the end edge of said adjacent bottom panel flap to an associated one of said lower fold lines;

each of said lower gusset panels being connected to an associated one of the side panel flaps along a second fold line extending at an angle to said associated lower fold line and to an associated one of the fold lines connecting said associated side panel flap to an associated side panel; and each of the side panel flaps including a slit extending from the end edge of the associated side panel flap to the second fold line.

3. A blank for forming a wrap-around carrier for packaging a plurality of articles, comprising:

a top panel section connected along fold lines at opposite sides thereof to side panel sections;

end flaps connected to opposite ends of the top panel section along fold lines;

each of said side panel sections being connected along a fold line to a bottom panel flap, the bottom panel flaps being adapted to be connected to each other to form the bottom panel of a carrier formed from the blank;

each of said side panel sections being connected along a fold line to a side panel flap having an end edge;

an upper gusset panel associated with each of said side panel flaps, each of said upper gusset panels connecting one of said side panel flaps to an associated one of the end flaps;

a lower gusset panel associated with each of said side panel flaps, each of said lower gusset panels connecting one of said side panel flaps to an end edge of an adjacent one of the bottom panel flaps, the lower gusset panels restraining outward movement of articles which are adjacent to the gusset panels in a carrier formed from the blank;

each of the lower gusset panels being connected to an adjacent one of the bottom panel flaps along a first diagonal fold line and to an adjacent one of the side panel flaps along a second diagonal fold line; and each of said side panel flaps including a slit extending from the end edge thereof to an associated one of the second diagonal fold lines.

* * * * *